US010913279B2

(12) United States Patent
Ikushima

(10) Patent No.: US 10,913,279 B2
(45) Date of Patent: Feb. 9, 2021

(54) METHOD AND DEVICE FOR FILLING OF LIQUID MATERIAL

(71) Applicant: MUSASHI ENGINEERING, INC., Mitaka (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 0 days.

(21) Appl. No.: 16/744,219

(22) Filed: Jan. 16, 2020

(65) Prior Publication Data

US 2020/0147971 A1 May 14, 2020

Related U.S. Application Data

(63) Continuation of application No. 15/027,125, filed as application No. PCT/JP2014/076544 on Oct. 3, 2014, now Pat. No. 10,569,555.

(30) Foreign Application Priority Data

Oct. 5, 2013 (JP) ..... 2013-209742

(51) Int. Cl.
*B41J 2/175* (2006.01)
*B41J 2/19* (2006.01)

(52) U.S. Cl.
CPC ..... *B41J 2/175* (2013.01); *B41J 2/17506* (2013.01); *B41J 2/17559* (2013.01); *B41J 2/19* (2013.01)

(58) Field of Classification Search
CPC .... B41J 2/175; B41J 2/17559; B41J 2/17506; B41J 2/19; B41J 2/17513; B41J 2/17556; B41J 29/00; B41J 29/393
(Continued)

(56) References Cited

U.S. PATENT DOCUMENTS 5,061,302 A ‡ 10/1991 Zuback ..... B01D 19/0005 95/266
5,584,416 A ‡ 12/1996 Florian ..... B01D 19/0036 222/1
(Continued)

FOREIGN PATENT DOCUMENTS

EP 2143503 A1 ‡ 1/2010 ..... B05C 5/0237
EP 2143503 A1 1/2010
(Continued)

OTHER PUBLICATIONS

Translation of International Preliminary Report on Patentability (Form PCT/IPEA/409) issued in counterpart International Application No. PCT/JP2014/076544 dated Mar. 2, 2016. (5 pages).‡
(Continued)

*Primary Examiner* — Timothy L Maust
*Assistant Examiner* — James R Hakomaki
(74) *Attorney, Agent, or Firm* — Westerman, Hattori, Daniels & Adrian, LLP

(57) ABSTRACT

A liquid material filling device and method are provided which are intended to prevent air bubbles from remaining along an entire length of a flow passage extending from a liquid material reservoir (51) to a discharge port (53). The liquid material filling device includes a chamber (10) of an airtight structure, a pressure regulator (70) for regulating pressure in the chamber (10), and a control device (100). The liquid material is filled as follows. A negative pressure supply source (71) is communicated with a chamber communication pipe (90) and with a discharge device communication pipe (91) to reduce the pressure in the chamber (10) and pressure in an upper space of the reservoir (51) to a vacuum or a low pressure level close to a vacuum, and a resulted low-pressure state is maintained for a certain time to expel out air bubbles in the liquid material.

8 Claims, 4 Drawing Sheets

(58) Field of Classification Search
USPC ..... 141/2
See application file for complete search history.

(56) References Cited

U.S. PATENT DOCUMENTS

| | | | | |
|---|---|---|---|---|
| 5,747,102 | A ‡ | 5/1998 | Smith | B05C 5/001 427/98 |
| 6,253,957 | B1 ‡ | 7/2001 | Messerly | B05C 5/001 222/1 |
| 6,267,266 | B1 ‡ | 7/2001 | Smith | B05C 5/001 222/1 |
| 6,846,360 | B2 ‡ | 1/2005 | Lei | H01L 21/6715 118/319 |
| 6,877,838 | B2 ‡ | 4/2005 | Elgee | B41J 2/0451 347/12 |
| 7,097,274 | B2 ‡ | 8/2006 | Mantooth | B41J 2/16517 347/30 |
| 2004/0020553 | A1 ‡ | 2/2004 | Amano | B65B 1/26 141/65 |
| 2004/0135858 | A1 ‡ | 7/2004 | Usui | B41J 2/16517 347/92 |
| 2005/0145292 | A1 ‡ | 7/2005 | De Costa | A47J 47/10 141/65 |
| 2007/0025180 | A1 ‡ | 2/2007 | Ishii | B01D 19/0052 366/139 |
| 2007/0086923 | A1 ‡ | 4/2007 | Li | B01L 3/0203 422/400 |
| 2007/0252860 | A1 ‡ | 11/2007 | Nitta | B41J 2/175 347/14 |
| 2010/0224071 | A1 ‡ | 9/2010 | Ikushima | B01D 19/0036 96/194 |
| 2010/0294810 | A1 ‡ | 11/2010 | Ikushima | B05C 5/0237 222/309 |
| 2011/0132490 | A1 ‡ | 6/2011 | Kuhni | A61J 1/20 141/7 |
| 2012/0217262 | A1 ‡ | 8/2012 | Ikushima | B05C 5/0225 222/1 |
| 2012/0288973 | A1 ‡ | 11/2012 | Matsunaga | B05B 13/041 438/29 |
| 2013/0029186 | A1 ‡ | 1/2013 | Takada | H01M 2/361 429/51 |
| 2013/0108521 | A1 ‡ | 5/2013 | Ikushima | B01L 3/0265 422/509 |

FOREIGN PATENT DOCUMENTS

| | | | | |
|---|---|---|---|---|
| JP | 2004-154765 | A ‡ | 6/2004 | B41J 2/19 |
| JP | 2004-154765 | A | 6/2004 | |
| JP | 2004-322099 | A ‡ | 11/2004 | B05C 5/001 |
| JP | 2004-322099 | A | 11/2004 | |
| JP | 2006-248083 | A ‡ | 9/2006 | |
| JP | 2006-248083 | A | 9/2006 | |
| JP | 2009-28676 | A ‡ | 2/2009 | |
| JP | 2009-28676 | A | 2/2009 | |
| WO | 2006/120048 | A2 | 11/2006 | |
| WO | WO 2006/120048 | A2 ‡ | 11/2006 | B41J 2/17506 |
| WO | 2007/097277 | A1 | 8/2007 | |
| WO | WO-2007/097277 | A1 ‡ | 8/2007 | B01D 19/0042 |

OTHER PUBLICATIONS

International Search Report dated Dec. 16, 2014, issued in International Application No. PCT/JP2014/076544 (2 pages).‡
Machine translation for JP 2006-248083.‡
Machine translation for JP 2009-28676.‡
Non-Final rejection dated Oct. 25, 2017 issued in parent application of U.S. Appl. No. 15/027,125.
Final rejection dated May 18, 2018 issued in parent application of U.S. Appl. No. 15/027,125.
Non-Final rejection dated Mar. 29, 2019 issued in parent application of U.S. Appl. No. 15/027,125.
Notice of Allowance dated Oct. 17, 2019 issued in parent application of U.S. Appl. No. 15/027,125.

‡ imported from a related application

[Fig. 1]
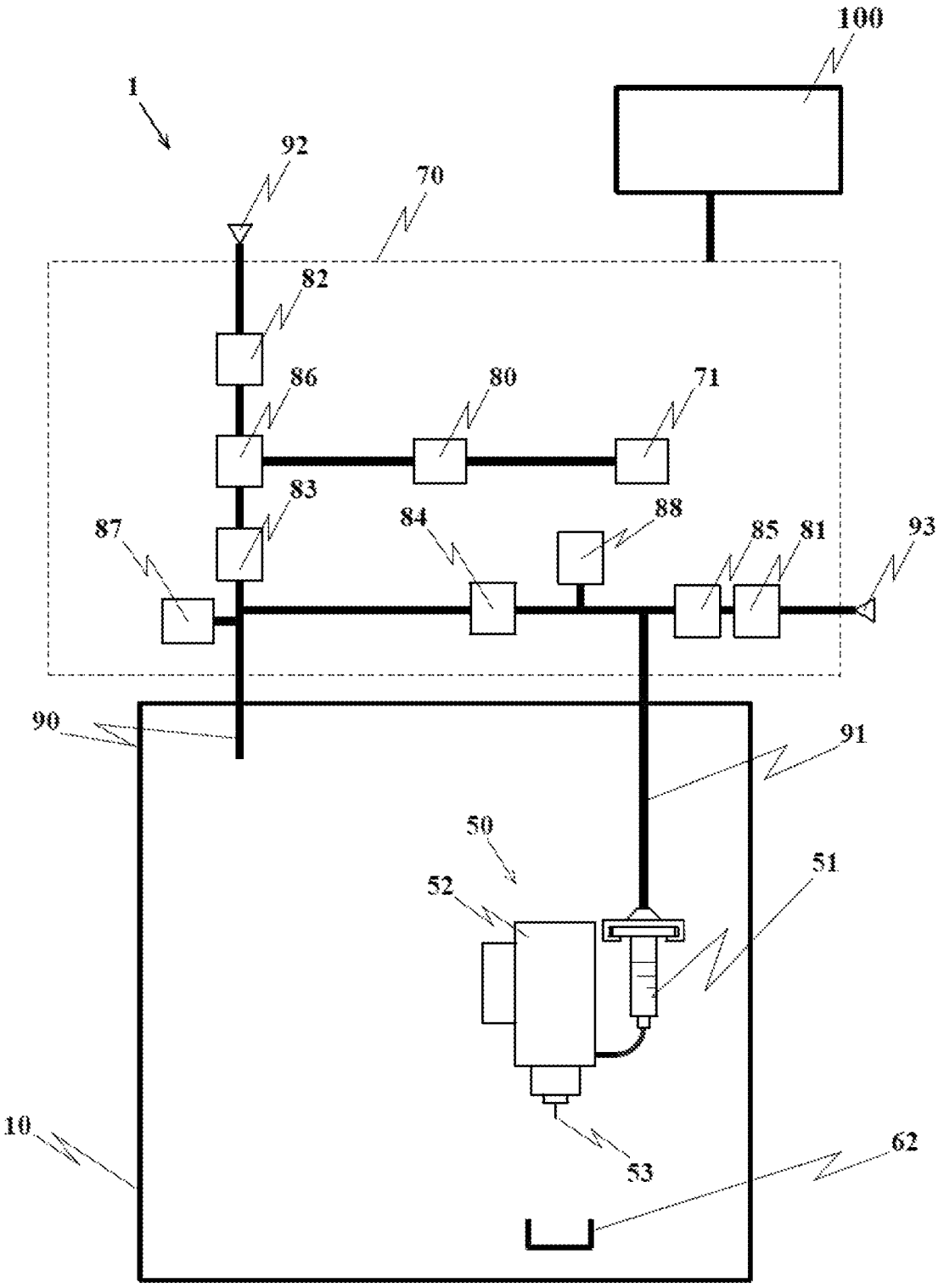

[Fig. 2]
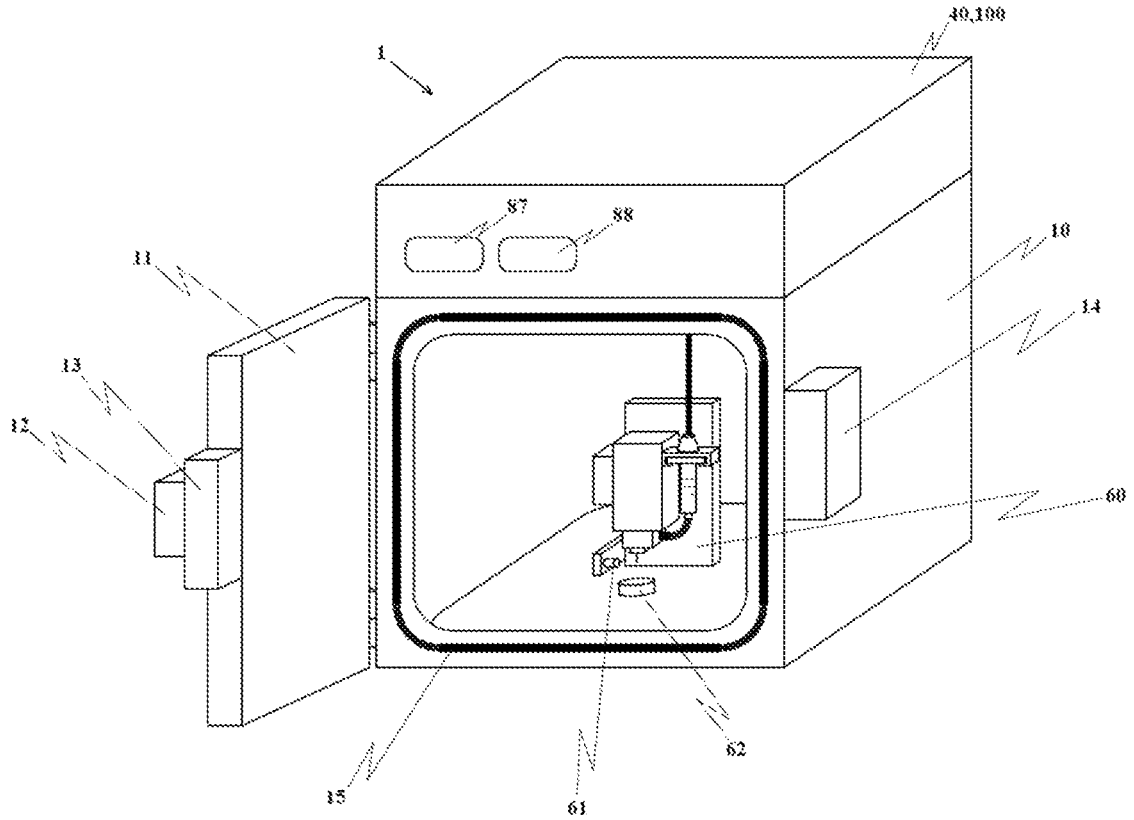

[Fig. 3]
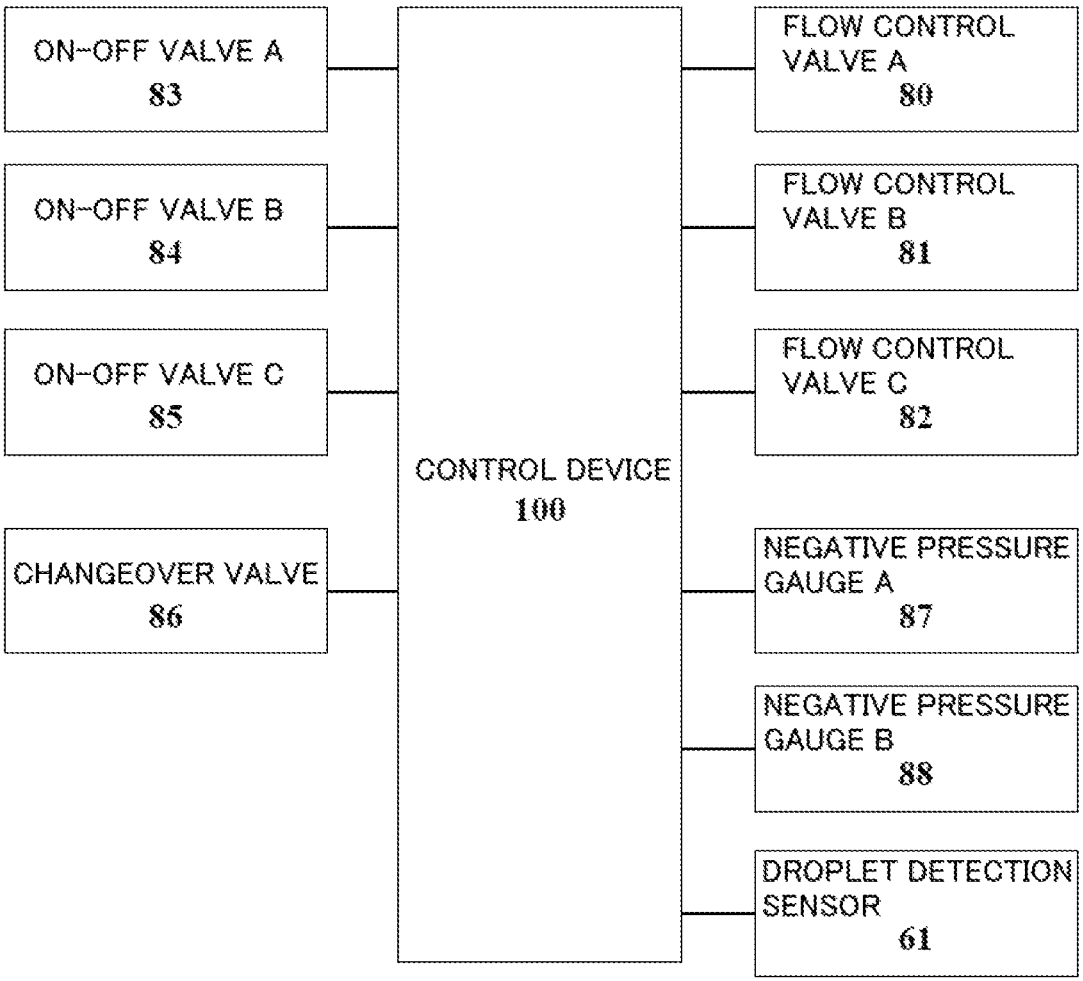

[Fig. 4]
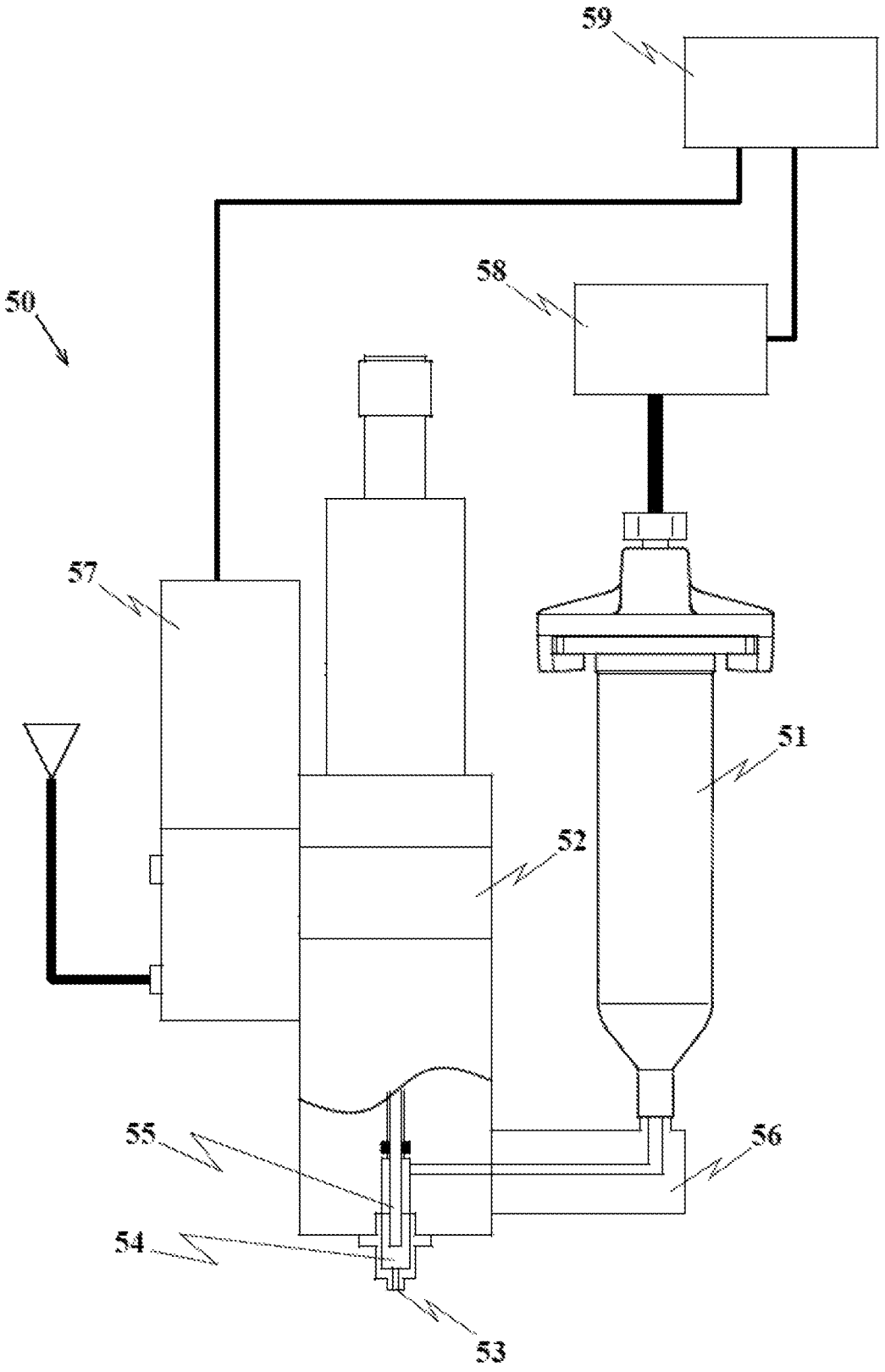

METHOD AND DEVICE FOR FILLING OF LIQUID MATERIAL

This application is a continuation of U.S. application Ser. No. 15/027,125, filed on Apr. 4, 2016, which is a National Stage of International Application No. PCT/JP2014/076544, filed on Oct. 3, 2014, which claims priority to Japanese priority application No. 2013-209742 filed on Oct. 5, 2013, which are all hereby incorporated by reference.

TECHNICAL FIELD

The present invention relates to a liquid material filling device and method for filling a liquid material into a liquid material discharge device. More particularly, the present invention relates to a liquid material filling device and method capable of, at the start of use of the liquid material discharge device, filling the liquid material in a manner of preventing air bubbles from remaining in a flow passage where the liquid material is not yet filled.

BACKGROUND ART

As an example of devices for discharging liquid materials, there is known a device that a shaft member being rotatable or movable forward and backward is disposed in a flow passage extending from a supply port to which the liquid material is supplied, to a discharge port from which the liquid material is discharged, and that the liquid material is discharged from the discharge port with the operation of the shaft member (see, e.g., Patent Document 1).

In the device disclosed in FIG. 1 of Patent Document 1, a liquid material stored in a syringe is introduced to a flow passage, which is formed in a housing of a distributor, through a hole, and the liquid material is discharged from a nozzle with forward movement of a shaft. Here, the shaft is inserted in a flow bore, and the flow passage is formed by a gap between the flow bore and the shaft inserted in the flow bore. Moreover, a seal ring is fitted over the shaft to avoid the liquid material from leaking toward a control mechanism that is a drive source for the shaft. Accordingly, the liquid material stored in the syringe is in such a state that the flow passage being present inside the distributor and leading to the discharge port of the nozzle is fully filled with the liquid material.

In relation to the discharge device constituted as described above, it is known that, if air bubbles exist within the flow passage, an amount of the liquid material discharged from the device may vary. Furthermore, if air bubbles are mixed into the liquid material at the start of use, the mixed air bubbles are difficult to expel out, and accurate discharge is impeded. More specifically, discharge failures may occur; namely, the air bubbles are discharged during the discharge and the liquid material is not discharged, or a droplet is not formed even when the liquid material is discharged. For that reason, it has been usual so far to perform a centrifugal debubbling process or a vacuum debubbling process on the reservoir (syringe) filled with the liquid material, and then to mount the reservoir to a body of the discharge device.

In a discharge device of ink jet type, there also arises a problem with mixing of air bubbles. More specifically, if air bubbles are mixed into ink, pressure of an expanding bubble generated due to heating and providing ink discharge energy, or pressure of a driver for pushing the ink is not appropriately transmitted to the nozzle. Hence a failure in ink discharge from a head nozzle tends to occur. To cope with the above problem, Patent Document 2 proposes a liquid filling method of placing a work inside a chamber of an airtight structure, reducing pressure in the chamber to a level close to a vacuum, and filling a fixed amount of liquid into the work by differential pressure between the vacuum pressure in the chamber and the atmospheric pressure in a supply tank where the liquid is stored.

CITATION LIST

Patent Documents

Patent Document 1: Japanese Patent Laid-Open Publication No. 2004-322099

Patent Document 2: Japanese Patent Laid-Open Publication No. 2006-248083

SUMMARY OF INVENTION

Technical Problem

With the prior art, even though the air bubbles can be removed from the liquid material in the reservoir (syringe), the following problem still remains unsolved. When the liquid material is introduced from the reservoir to the flow passage inside the body of the discharge device, gas existing in the flow passage remains in a bent portion or a stepped portion of the flow passage, thus causing new air bubbles to be generated.

The filling method disclosed in Patent Document 2 is able to remove air bubbles in the ink reservoir, but it still has a possibility that new air bubbles may mix into ink in a flow passage communicating the ink reservoir and a cap with each other. More specifically, there is a possibility that, because a three-way valve and a flow control valve, which are disposed between the ink reservoir and the cap, include bent portions and stepped portions, air bubbles may remain in those portions.

Furthermore, there is a possibility that air bubbles are generated when the ink is sucked into an air bypass upon switching-over of the three-way valve (see paragraph [0039] in Patent Document 2), and hence that the ink including the air bubbles remains in the flow passage even after the ink has been discharged out to an ink pan.

In view of the above-mentioned state of the art, an object of the present invention is to provide a liquid material filling device and method, which can prevent air bubbles from remaining along an entire length of a flow passage extending from a liquid material reservoir to a discharge port.

Solution to Problem

The present invention provides a liquid material filling device for filling a liquid material into an inner flow passage of a discharge device, the liquid material filling device comprising a chamber of an airtight structure, a pressure regulator for regulating pressure in the chamber, and a control device, wherein the discharge device includes a liquid reservoir that has an outlet in communication with a discharge port, and that has a connector, the pressure regulator includes a negative pressure supply source, a chamber communication pipe in communication with the chamber, a discharge device communication pipe in communication with the connector of the liquid reservoir, an on-off valve A for establishing or cutting off communication between the chamber communication pipe and a gas supply port, an on-off valve B for establishing or cutting off communication between the chamber communication pipe and the discharge device communication pipe, an on-off valve C for establishing or cutting off communication between the discharge device communication pipe and a gas supply port, and a pressure gauge, and the control device includes pressure reducing means for communicating the negative pressure supply source with the chamber communication pipe and with the discharge device communication pipe, and reducing the pressure in the chamber and pressure in an upper space of the reservoir to a vacuum or a low pressure level close to a vacuum, degassing means for maintaining the inside of the chamber and the upper space of the reservoir in a low-pressure state for a certain time, and expelling out air bubbles in the liquid material, filling means for communicating the upper space of the reservoir with the gas supply port, introducing gas to flow into the relevant space, and increasing the pressure in the relevant space to become higher than the pressure in the chamber such that the liquid material within the reservoir is filled into the discharge device, filling stop means for communicating the upper space of the reservoir with the inside of the chamber, and establishing a pressure equilibrium state, and pressure release means for communicating the inside of the chamber and the upper space of the reservoir with the gas supply port.

The liquid material filling device described above, preferably, further comprises a changeover valve for changing over a first position at which the chamber communication pipe and the negative pressure supply source are communicated with each other, and a second position at which the chamber communication pipe and the gas supply port are communicated with each other, and the control device operates the changeover valve to the first position in the pressure reducing means, and operates the changeover valve to the second position in the pressure releasing means. More preferably, the liquid material filling device described above further comprises a first flow control valve disposed in a flow passage through which the chamber communication pipe and the gas supply port are communicated with each other, and a second flow control valve disposed in a flow passage through which the discharge device communication pipe and the gas supply port are communicated with each other. Even more preferably, a maximum flow rate through the first flow control valve is set to be not less than three times a maximum flow rate through the second flow control valve.

In the liquid material filling device described above, the control device may further include a sensor for sending a liquid detection signal.

The present invention provides a liquid material filling method for filling a liquid material into an inner flow passage of a discharge device that is placed inside a chamber, the discharge device including a liquid reservoir that has an outlet in communication with a discharge port, and that has a connector connected to a pipe through which negative pressure is supplied, wherein the liquid material filling method comprises a pressure reducing step of reducing pressure in the chamber and pressure in an upper space of the reservoir to a vacuum or a low pressure level close to a vacuum, a degassing step of maintaining the inside of the chamber and the upper space of the reservoir in a low-pressure state for a certain time, and expelling out air bubbles in the liquid material, a filling step of communicating the upper space of the reservoir with a gas supply port, introducing gas to flow into the relevant space, and increasing the pressure in the relevant space to become higher than the pressure in the chamber such that the liquid material within the reservoir is filled into the discharge device, a filling stop step of, after detecting that a droplet has flowed out from the discharge port, promptly communicating the upper space of the reservoir with the inside of the chamber, thus establishing a pressure equilibrium state and stopping the filling of the liquid material, and a pressure release step of communicating the inside of the chamber and the upper space of the reservoir with a gas supply port, and introducing gas to flow into the chamber and the relevant space.

In the liquid material filling method described above, in the pressure reducing step, a flow control valve may be adjusted with time to moderately expel out air in the chamber and the reservoir.

In the liquid material filling method described above, in the filling step, the gas may be moderately introduced to flow into the upper space of the reservoir while a flow control valve is adjusted with time, and in the pressure release step, the gas may be moderately introduced to flow into the upper space of the reservoir while a flow control valve is adjusted with time. Preferably, in the pressure release step, a maximum flow rate through the flow control valve is set to be not less than three times a maximum flow rate through the flow control valve in the filling step.

In the liquid material filling method described above, the discharge device may be a discharge device including a rod that is operated in a liquid chamber in communication with the discharge port.

Advantageous Effect of Invention

According to the present invention, a liquid material filling device and method are provided which can prevent air bubbles from remaining along an entire length of a flow passage extending from a liquid material reservoir to a discharge port.

BRIEF DESCRIPTION OF THE DRAWINGS

FIG. 1 is a schematic view illustrating the constitution of a liquid material filling device according to the present invention.

FIG. 2 is a perspective view illustrating a state where a discharge device is installed inside the liquid material filling device according to the present invention.

FIG. 3 is a block diagram illustrating the configuration of a control device.

FIG. 4 is a partly-sectioned side view illustrating the constitution of the discharge device.

DESCRIPTION OF EMBODIMENTS

One exemplary embodiment for carrying out the present invention will be described below with reference to the drawings.

<Constitution>

As illustrated in FIG. 1, a liquid material filling device 1 according to the present invention includes, as main components, a chamber 10, a pressure regulator 70, and a control device 100. A discharge device 50 is installed in the chamber 10 of an airtight structure, and a filling step is performed in such a state. The pressure regulator 70 is to regulate respective pressures in the chamber 10 and a reservoir 51 of the discharge device 50, and the operation of the pressure regulator 70 is controlled by the control device 100.

As illustrated in FIG. 2, the chamber 10 includes a door 11 fixed in place by hinges, a grip 12, locking members 13 and 14, and an airtight sealing member 15.

The door 11 is opened and closed by a user grasping the grip 12. The inside of the chamber can be kept airtight by fixedly holding the door 11 with engagement of the locking member A 13 and the locking member B 14 in a state that the door 11 is closed and is pressed against the airtight sealing member 15 disposed in the form of a frame. The control device 100 and the pressure regulator 70 are installed in a rectangular parallelepiped housing above the chamber 10. A negative pressure gauge A 87 and a negative pressure gauge B 88 are disposed at the front of the housing such that the user can visually recognize those negative pressure gauges from the front side.

The pressure regulator 70 includes a negative pressure supply source 71, flow control valve 80 to 82, on-off valves 83 to 85, a changeover valve 86, and the negative pressure gauges 87 and 88.

The negative pressure supply source 71 is to supply predetermined negative pressure, and it can be constituted, for example, as a combination of a vacuum pump and a pressure reducing valve.

The changeover valve 86 changes over a first position at which the negative pressure supply source 71 and the on-off valve A 83 are communicated with each other, and a second position at which the on-off valve A 83 and a gas supply port 92 are communicated with each other through the flow control valve C 82.

One end of a pipe A 90 inserted into the chamber 10 is opened to a chamber space. One end of a pipe B 91 inserted into the chamber 10 is communicated with a lower end outlet of the reservoir 51. The pipe A 90 and the pipe B 91 are communicated, as illustrated in FIG. 1, with the gas supply ports 92 and 93 and with negative pressure supply source 71 through the flow control valves 80 to 82, the on-off valves 83 to 85, and the changeover valve 86. While, in this embodiment, the gas supply ports are communicated with the atmosphere to supply atmospheric gas, the gas supply ports may be communicated with an inert gas supply source to supply inert gas.

As illustrated in FIG. 3, the control device 100 is electrically connected to a droplet detection sensor 61 and individual components of the pressure regulator 70. The control device 100 includes an arithmetic device and a storage device. In a filling step described later, the control device 100 automatically controls the operations of the changeover valve 86 and the on-off valves 83 to 85 in accordance with signals from the droplet detection sensor 61 and the negative pressure gauges 87 and 88. When the operations of the components of the pressure regulator 70 are controlled on the basis of a time schedule, the control device 100 may include a timer that is implemented with hardware or software.

The droplet detection sensor 61 detects a droplet (or a liquid in the form of a string) discharged from a discharge port 53 of the discharge device 50, and sends a detection signal to the control device 100. A weighing device for measuring the weight of the droplet may be provided in a receiving pan 62, and the discharge of the droplet may be detected depending on a weight change of the receiving pan 62.

FIG. 4 is a partly-sectioned side view illustrating the constitution of the discharge device 50.

The reservoir 51 and a discharge device body 52 are coupled to each other through a liquid feed member 56 including a flow passage formed therein. An electromagnetic valve 57 is fixed to one lateral surface of the discharge device body 52.

A tip of a rod 55 extending in a vertical direction is arranged in a liquid chamber 54 in communication with the discharge port 53. The rod 55 is reciprocally moved within the liquid chamber 54 by a rod driving source that is constituted by, e.g., a piezoelectric element.

The reservoir 51 has an outlet at its lower end and an opening at its upper end. An air tube is connected to a cover member (connector) that covers the opening of the reservoir 51, and is communicated with an air supply port of an air pressure supply unit 58. A controller 59 controls the operations of the electromagnetic valve 57 and the air pressure supply unit 58.

When the discharge device 50 is installed inside the chamber 10, the discharge device 50 is disconnected from the air pressure supply unit 58 and the controller 59. On that occasion, the rod 55 is fixedly held at an elevated position such that the rod 55 does not close the flow passage communicating the liquid chamber 54 and the discharge port 53. In other words, the discharge device 50 is installed inside the chamber 10 in a state where the discharge port 53 and the outlet of the liquid reservoir 51 are communicated with each other.

In use, the discharge device 50 is mounted to an application apparatus including a work table on which an application object is placed, an XYZ-direction moving device for relatively moving the discharge device, which discharges a fixed amount of the liquid, and the work table, and a control unit for controlling the operation of the XYZ-direction moving device.

The discharge device 50 illustrated in FIG. 4 is merely one example, and the present invention is applicable to any type of discharge device in which a rod is operated in a liquid chamber communicating with a discharge port. The present invention can be applied to, e.g., a discharge device of jet type in which a valve member is impinged against a valve seat disposed at an end of a flow passage in communication with a nozzle, or it is stopped immediately before impinging against the valve seat, thereby causing a liquid material to be discharged in a flying way, a discharge device of plunger type in which the liquid material is discharged by moving a plunger through a predetermined distance, the plunger sliding in close contact with an inner surface of a reservoir that includes a nozzle at its tip, and a discharge device of screw type in which the liquid material is discharged with rotation of a screw.

<Filling Step>

(Preparation Step: Mounting of Discharge Device, Etc.)

An operator performs the following operations as a preparation step.

(1) Mount the discharge device 50 to a holder 60 disposed inside the chamber 10.

(2) Connect the pipe B 91 to the cover member covering the opening of the reservoir 51 that stores the liquid material, thereby forming a closed space in the reservoir 51 on the upper side.

(3) Install the receiving pan 62 under the discharge port 53 of the discharge device 50.

(4) Adjust a detection range of the droplet detection sensor 61 to be overlapped with a vertical line extending from the discharge port 53 of the discharge device 50 downwards.

(First Step: Reducing Pressures in Chamber and Reservoir)

The control device 100 operates the changeover valve 86 to the first position at which the negative pressure supply source 71 and the on-off valve A 83 are communicated with each other, opens both the on-off valve A 83 and the on-off valve B 84, and closes the on-off valve C 85. In this state, the negative pressure supply source 71 is communicated with the chamber 10 through the pipe A 90 and with the reservoir 51 through the pipe B 91. Therefore, pressure in the chamber 10 and pressure of gas present in the upper space of the reservoir 51 are reduced due to the negative pressure supplied from the negative pressure supply source 71.

Because the discharge port 53 of the discharge device 50 is opened to the chamber space, pressure in an inner flow passage of the discharge device body 52 communicating with the discharge port 53 is also reduced with reduction of the pressure in the chamber 10. On that occasion, the control device 100 preferably performs control to adjust the flow control valve A 80 with time such that air in both the chamber 10 and the reservoir 51 is not abruptly evacuated. The reason is that, if an abrupt pressure change is generated in the flow passage inside the discharge device 50 and the reservoir 51, a possibility of mixing of air bubbles occurs, and that, particularly if the liquid material in the reservoir 51 is disturbed, the possibility of mixing of air bubbles increases significantly.

(Second Step: Removal of Air Bubbles)

When detection values of the negative pressure gauge A 87 and the negative pressure gauge B 88 each reach desired pressure (i.e., a vacuum or low pressure close to a vacuum), the control device 100 closes the on-off valve A 83. With the closing of the on-off valve A 83, the supply of the negative pressure from the negative pressure supply source 71 to both the chamber 10 and the reservoir 51 is stopped, thus resulting in a state where the pressure in the chamber 10, the pressure in the reservoir 51, and the pressure in the inner flow passage of the discharge device body 52 are equal to one another. In such a state, the inner flow passage of the discharge device body 52 is substantially brought into a vacuum state, and air bubbles are removed from all the liquid material present inside the chamber 10. This step of removing the air bubbles is continued for a certain time set in advance.

(Third Step: Start of Filling of Liquid Material)

After the lapse of the certain time, the control device 100 closes the on-off valve B 84 to cut off the communication between the pipe A 90 and the pipe B 91. As a result, the communication between the chamber 10 and the upper space of the reservoir 51 is also cut off. Thereafter, the control device 100 closes the flow control valve B 81 and then opens the on-off valve C 85. At that time, because the flow control valve B 81 is closed, a reading of the negative pressure gauge B 88 is not changed.

The control device 100 then gradually opens the flow control valve B 81. With the opening of the flow control valve B 81, atmospheric gas flows into the upper space of the reservoir 51 from the gas supply port 93 through the on-off valve C 85. On that occasion, the control device 100 preferably adjusts an opening degree of the flow control valve B 81 such that the liquid material in the reservoir 50 does not abruptly flow into the inner flow passage of the discharge device body 52.

As an amount of the atmospheric gas flowing into the reservoir 51 increases, the pressure in the reservoir 51 rises and the reading of the negative pressure gauge B 88 also increases. The inflow of the atmospheric gas into the reservoir 51 (i.e., a pressure rise therein) is continued until the negative pressure gauge B 88 indicates a desired pressure value. Because the communication between the flow passage (pipe) B 91 and the flow passage (pipe) A 90 is kept cut off with the presence of the liquid material inside the reservoir 51, a reading of the negative pressure gauge A 87 does not increase. A difference between the reading of the negative pressure gauge A 87 and the reading of the negative pressure gauge B 88 indicates a differential pressure between the reservoir 51 and the inner flow passage of the discharge device body 52. The differential pressure serves as propulsion pressure for feeding the liquid material inside the reservoir 51 to the inner flow passage of the discharge device. The negative pressure in the chamber 10 is, e.g., −60 to −100 kPa, and the differential pressure between the negative pressure gauge A and the negative pressure gauge B is, e.g., several ten kPa to several hundred kPa.

While the above description is made in connection with the method of opening the on-off valve C 85 and then opening the flow control valve B 81 by the control device 100, the on-off valve C 85 may be opened after setting the opening degree of the flow control valve B 81 in advance by the control device 100.

(Fourth Step: Stop of Filling of Liquid Material)

Upon the reading of the negative pressure gauge B 88 reaching the desired value, the control device 100 closes the on-off valve C 85. Instead of utilizing the reading of the negative pressure gauge B 88, the on-off valve C 85 may be closed after the lapse of a certain time. On that occasion, the differential pressure between the negative pressure gauge A 87 and the negative pressure gauge B 88 is maintained with the on-off valve B 84 being kept closed. Accordingly, the liquid material continues to moderately flow into the inner flow passage of the discharge device body 52 from the reservoir 51. When it is ascertained from the detection signal from the droplet detection sensor 61 that the liquid material having flowed from the reservoir 51 has reached the discharge port 53, the control device 100 opens the on-off valve B 84 to communicate the pipe A 90 and the pipe B 91 with each other. As a result, the difference between the pressure in the reservoir 51 and the pressure in the chamber 10 is eliminated, and the inflow of the liquid material into the inner flow passage of the discharge device body 52 from the reservoir 51 is stopped. At that time, the readings of the negative pressure gauge A 87 and the negative pressure gauge B 88 are equal to each other (pressure equilibrium state).

(Fifth Step: Release of Negative Pressure in Chamber)

The control device 100 sets the changeover valve 86 to the second position, thereby communicating the on-off valve A 83 and the flow control valve C 82 with each other. At that time, the on-off valve A 83 and the flow control valve C 82 are in the closed state, and the on-off valve B 84 is in the opened state. Then, the control device 100 opens the on-off valve A 83 and gradually opens the flow control valve C 82. As a result, the atmospheric gas flows, from the gas supply port 92, into the chamber 10 through the pipe A 90, and into the upper space of the reservoir 51 through the pipe B 91. Accordingly, the pressures in the chamber 10 and the reservoir 51 rise and become equal to the atmosphere pressure.

While the above description is made in connection with the method of opening the on-off valve A 83 and then opening the flow control valve C 82 by the control device 100, the on-off valve A 83 may be opened after setting the opening degree of the flow control valve C 82 in advance by the control device 100.

Alternatively, in this step, the atmospheric gas may be introduced, from the gas supply port 93, to flow into the chamber 10 and the upper space of the reservoir 51. In other words, the control device 100 may, from the state where the on-off valve A 83, the on-off valve C 85 and the flow control valve B 81 are closed and the on-off valve B 84 is opened, open the on-off valve C 85 and gradually open the flow control valve B 81. Also on that occasion, the on-off valve C 85 may be opened after setting the opening degree of the flow control valve B 81 in advance by the control device 100. When the negative pressure in the chamber is released through the gas supply port 93, the changeover valve 86 is not required, and the flow control valve A 80 and the on-off valve A 83 can be directly coupled to each other.

However, the inflow ports for the atmospheric gas are preferably provided as separate ports in some cases for the reason that, comparing the inflow of the atmospheric gas into the reservoir 51 in the third step and the inflow of the atmospheric gas into the chamber in the fifth step, the inflow amount of the atmospheric gas is much larger in the fifth step. Stated in another way, the case of providing the changeover valve 86 as well is advantageous in that it is possible to introduce the atmospheric gas to flow in from the gas supply port 92 through one valve adapted for a large flow rate, and to introduce the atmospheric gas to flow in from the gas supply port 93 through another valve adapted for a small flow rate. As a result, the negative pressure in the chamber can be quickly released in the fifth step. For example, a maximum flow rate through the flow control valve C 82 can be set to be not less than three times (preferably not less than five times and more preferably not less than ten times) that through the flow control valve B 81.

(Posterior Step: Taking-Out of Discharge Device)

The operator visually checks that the readings of the negative pressure gauges A 87 and B 88 have returned to the atmospheric pressure, and then takes out the discharge device 50 (i.e., the reservoir 51 and the discharge device body 52) from the chamber 10.

While the above-described first to fifth steps are automatically executed in principle, it is a matter of course that a part or the whole of those steps may be manually performed.

According to the liquid material filling device 1 described above, since the liquid material is filled in the vacuum state or in the substantially vacuum state where the atmosphere does not remain, the liquid material with no air bubbles remained therein can be caused to fill throughout the flow passage extending from the reservoir to the discharge port. Furthermore, since the discharge device is itself placed in the chamber and is held in the vacuum state, there is no possibility that gas flows into the inner flow passage of the discharge device from the discharge port.

Thus, according to the present invention, since no air bubbles remain in the flow passage extending from the reservoir to the discharge port, advantageous effects are obtained in that an amount of the discharged liquid material is stabilized, and that discharge failures are not caused. Furthermore, since liquid dripping or posterior dripping from the discharge port attributable to the remaining air bubbles does not occur, the liquid material can be discharged in a clean condition. Moreover, in a discharge device of the type discharging the liquid material from the discharge port in a state of droplets, accuracy of droplet-landed positions is increased. The present invention is so much effective especially in a mechanical discharge device in which a tip of an operating shaft (rod) is arranged in a liquid chamber communicating with a discharge port.

LIST OF REFERENCE SIGNS

1: liquid material filling device
10: chamber
11: door
12: grip
13: locking member A
14: locking member B
15: sealing member
50: discharge device
51: reservoir (syringe)
52: discharge device body
53: discharge port
54: liquid chamber
55: rod
56: liquid feed member
57: electromagnetic valve
58: air pressure supply unit
59: controller
60: holder
61: droplet detection sensor
62: receiving pan
70: pressure regulator
71: negative pressure supply source
80: flow control valve A
81: flow control valve B
82: flow control valve C
83: on-off valve A
84: on-off valve B
85: on-off valve C
86: changeover valve
87: negative pressure gauge A (pressure gauge A)
88: negative pressure gauge B (pressure gauge B)
90: pipe A (chamber communication pipe)
91: pipe B (discharge device communication pipe)
92: gas supply port
93: gas supply port
100: control device

The invention claimed is:

1. A liquid material filling device comprising:
a chamber of an airtight structure;
a pressure regulator for regulating pressure in the chamber; and
a control device;
the pressure regulator comprising:
a negative pressure supply source;
a first gas supply port;
a second gas supply port;
a first communication pipe in communication with the chamber;
a second communication pipe connectable to a liquid reservoir inside the chamber;
a changeover valve for changing over a first position at which the first communication pipe and the negative pressure supply source are communicated with each other, and a second position at which the first communication pipe and the first gas supply port are communicated with each other;
an on-off valve A for establishing or cutting off communication between the first communication pipe and the changeover valve;
an on-off valve B for establishing or cutting off communication between the first communication pipe and the second communication pipe; and
an on-off valve C for establishing or cutting off communication between the second communication pipe and the second gas supply port;
wherein the chamber includes a door, and
wherein the pressure regulator is disposed outside the chamber and communicated with the chamber via the first communication pipe and the second communication pipe.

2. The liquid material filling device according to claim 1, wherein the control device is constituted so as to control the changeover valve, the on-off valve A, the on-off valve B and the on-off valve C.

3. The liquid material filling device according to claim 2, wherein the control device comprising:

a first function for supplying a negative pressure to the first communication pipe and the second communication pipe from the negative pressure supply source by operating the changeover valve to the first position, opening both the on-off valve A and the on-off valve B, and closing the on-off valve C;

a second function for communicating the first communication pipe and the second communication pipe by closing both the on-off valve A and the on-off valve C, and opening the on-off valve B;

a third function for supplying a gas to the second communication pipe from the second gas supply port by closing the on-off valve B, and opening the on-off valve C; and a fourth function for supplying a gas to the first communication pipe and the second communication pipe from the first gas supply port by operating the changeover valve to the second position, opening both the on-off valve A and the on-off valve B, and closing the on-off valve C.

4. The liquid material filling device according to claim 1, wherein the first gas supply port and the second gas supply port are constituted by a same gas supply port.

5. The liquid material filling device according to claim 1, wherein the pressure regulator further comprising:

a first flow control valve for adjusting a flow rate of a gas supplied to the first communication pipe; and a second flow control valve for adjusting a flow rate of a gas supplied to the second communication pipe.

6. The liquid material filling device according to claim 5, wherein a maximum flow rate through the first flow control valve is not less than three times a maximum flow rate through the second flow control valve.

7. The liquid material filling device according to claim 1, wherein the pressure regulator further comprising:

a pressure gauge A for measuring a pressure of the first communication pipe in a state where the on-off valve B is closed, a pressure gauge B for measuring a pressure of the second communication pipe in a state where the on-off valve B is closed.

8. The liquid material filling device according to claim 1, wherein the chamber further includes a sensor for detecting a liquid inside the chamber.

* * * * *